US007152428B2

(12) United States Patent
Lee et al.

(10) Patent No.: US 7,152,428 B2
(45) Date of Patent: Dec. 26, 2006

(54) REFRIGERATION SYSTEM

(75) Inventors: Guang-Chung Lee, Houston, TX (US); Rian Reyneke, Katy, TX (US); Michael J. Foral, Aurora, IL (US); Christos Papadopoulos, Naperville, IL (US); Wayne W. Y. Eng, League City, TX (US); Jeff Logsdon, Naperville, IL (US)

(73) Assignee: BP Corporation North America Inc., Warrenville, IL (US)

( * ) Notice: Subject to any disclaimer, the term of this patent is extended or adjusted under 35 U.S.C. 154(b) by 235 days.

(21) Appl. No.: 10/903,837

(22) Filed: Jul. 30, 2004

(65) Prior Publication Data

US 2006/0021377 A1 Feb. 2, 2006

(51) Int. Cl.
*F25J 1/00* (2006.01)

(52) U.S. Cl. ..... 62/612

(58) Field of Classification Search ..... 62/612–614, 62/617, 619, 622, 627, 630, 631, 634, 638; 95/172, 176, 177, 192, 208, 227, 228, 229
See application file for complete search history.

(56) References Cited

U.S. PATENT DOCUMENTS 2,582,068 A * 1/1952 Roberts ..... 62/634
3,186,182 A * 6/1965 Moon et al. ..... 62/630
4,002,042 A * 1/1977 Pryor et al. ..... 62/627
4,270,939 A * 6/1981 Rowles et al. ..... 62/627
4,519,825 A * 5/1985 Bernhard et al. ..... 62/627
4,664,687 A * 5/1987 Bauer ..... 62/622
4,759,786 A * 7/1988 Atkinson et al. ..... 62/631
4,867,773 A * 9/1989 Thorogood et al. ..... 62/652
5,035,732 A * 7/1991 McCue, Jr. ..... 62/627
5,768,913 A 6/1998 McCue, Jr. et al. ..... 62/625
6,112,550 A * 9/2000 Bonaquist et al. ..... 62/646
6,266,977 B1 * 7/2001 Howard et al. ..... 62/623
6,705,113 B1 * 3/2004 Wei et al. ..... 62/612
6,978,638 B1 * 12/2005 Brostow et al. ..... 62/623

FOREIGN PATENT DOCUMENTS

JP 57-82101 A * 5/1982

* cited by examiner

*Primary Examiner*—Mohammad M. Ali
(74) *Attorney, Agent, or Firm*—James R. Henes

(57) ABSTRACT

A refrigeration process is disclosed that employs a mixed refrigerant to chill a process gas stream in which a second stream is cooled against rewarming vaporized mixed refrigerant at low pressure and subsequently is at least partially vaporized against at least partially condensed mixed refrigerant at a higher pressure.

25 Claims, 1 Drawing Sheet

REFRIGERATION SYSTEM

BACKGROUND OF THE INVENTION

1. Field of Invention

The present invention pertains to a refrigeration process that employs a mixed refrigerant system to chill a process gas stream, and more particularly to an improved mixed refrigeration system in which a second stream, distinct from the process gas stream to be chilled, is cooled against rewarming vaporized mixed refrigerant, and then throttled and at least partially vaporized to provide duty to at least partially condense the compressed mixed refrigerant.

2. Description of the Prior Art

Mixed refrigerant systems have been well known in the industry for many decades. In these systems, multiple components are utilized in a single refrigeration system to provide refrigeration covering a wider range of temperatures, enabling one mixed refrigeration system to replace multiple pure component cascade refrigeration systems. The mixed refrigeration systems have found widespread use in base load liquid natural gas plants.

Mixed refrigerant systems have been used extensively in many applications, for example, in the chilling and liquefaction of natural gas to produce natural gas liquids or liquefied natural gas, and within the chilling and demethanization steps in an ethylene production process. The advantages of using a mixed refrigerant as compared with a one-component refrigerant system include both energy and capital savings. Energy savings can be achieved because mixed refrigerants provide a better match between process cooling curves and refrigerant evaporating curves and therefore reduce energy losses due to the required temperature driving forces. Capital savings can arise because fewer compressor stages may be needed, and they may be able to be constructed from cheaper non-cryogenic materials.

A typical mixed refrigerant system consists of a compressor of one or more stages that compresses a relatively low pressure mixed refrigerant stream to a higher pressure. This higher-pressure stream is then at least partially condensed to provide a liquid mixed refrigerant. This liquid mixed refrigerant can be subcooled before it is flashed to a lower pressure. This flashed stream is at a lower temperature than the high-pressure stream, and still contains some liquid. This liquid is vaporized at the lower temperature to provide refrigeration to a process stream or streams. Typically the process stream is chilled in multiple stages, with refrigeration to each of these stages provided by vaporizing or reheating the mixed refrigerant. The vaporized mixed refrigerant is typically reheated to some optimum temperature against the process stream to extract the maximum amount of refrigeration from the mixed refrigerant. The mixed refrigerant stream is typically fully vaporized by heat exchange with the process stream or streams.

Much effort has gone into optimizing the design of these mixed refrigerant systems, with particular attention being paid to how the compressed and (at least partially) condensed mixed refrigerant is handled and brought into heat exchange with the process stream that is to be chilled. Multiple patent and literature citations attest to the variety of mixed refrigerant system designs that alter, for example, the number of vaporization pressure levels, the treatment of gas and liquid mixed refrigerant streams in partially condensed systems, the number of vaporization steps, and the integration of these parameters with the process stream to be chilled.

In a mixed refrigerant system one of the major duties is the condensing of the compressed mixed refrigerant. This will typically be done at least partially against cooling water or other ambient cooling stream. In addition a separate propane or propylene refrigeration system could also be used to provide some of the condensing duty for the mixed refrigerant. Other cold process streams that need to be warmed can also be used to condense the mixed refrigerant stream. In addition, some of the condensing duty is typically provided by vaporization of the low-pressure mixed refrigerant itself. Likewise, more refrigeration can be recovered from the vaporized mixed refrigerant stream by reheating it against a process stream that needs to be cooled. Warming the vaporized mixed refrigerant before returning it to the compressor may also allow the mixed refrigerant compressor to be constructed out of a cheaper non-cryogenic material, resulting in capital savings.

We have found that the process can be simplified and energy savings realized when a single stream is used to both reheat the vaporized mixed refrigerant stream and provide condensation duty to the compressed mixed refrigerant. A key aspect of this invention is that a relatively high-pressure liquid stream is subcooled against the reheating vaporized mixed refrigerant stream, then it is flashed to a lower pressure and vaporized to provide the condensing duty to the compressed mixed refrigerant stream.

It has never been suggested that the mixed refrigerant vapor can be reheated against a stream other than a process stream to be chilled. McCue et al., U.S. Pat. No. 5,768,913 discloses a process and system for providing cooling for a gas separation process wherein the refrigerant is obtained from the system process fluid and after serving as a refrigerant is returned to the process side for separation into product. The patent teaches subcooling a liquid process stream and then throttling the subcooled liquid to provide refrigeration to the process. At least some of the subcooled liquid is throttled to provide the subcooling duty.

The process of this invention is an improvement over prior art processes in that it reduces the energy required for operation of the mixed refrigeration system. It recognizes the beneficial synergy between the required heating and cooling duties of a mixed refrigerant system and the heating duty required in vaporizing a liquid stream. Furthermore the process of this invention utilizes the heating duty of the mixed refrigeration system in a more desirable way than prior art processes. Subcooling the liquid before vaporization makes more of its latent heat of vaporization available at a lower temperature for mixed refrigerant condensation, and this subcooling is itself useful in the mixed refrigerant system. Moreover it has been found that this invention is particularly beneficial when the refrigeration system utilizes a mixed refrigerant and the liquid stream is not a single component—it boils over a relatively large temperature range.

An improved process is disclosed for the design of a mixed refrigeration system for chilling a process gas. The improvement comprises utilizing a second stream, distinct from the process gas to be chilled, to provide condensing duty to the compressed mixed refrigerant stream. The second stream is first cooled against a rewarming vaporized mixed refrigerant stream, and then throttled and at least partially vaporized to provide duty to at least partially condense a compressed mixed refrigerant stream.

SUMMARY OF THE INVENTION

The present invention is an improvement in a refrigeration process employing a mixed refrigerant stream, which comprises: heating the mixed refrigerant stream at relatively low pressure by indirect heat exchange with a first process stream to thereby cool and, optionally when the first process steam is a vapor or partially a vapor, at least partially liquefy the first process stream; flashing the aforesaid cooled first process stream to a lower pressure; and cooling and at least partially condensing the aforesaid mixed refrigerant stream at relatively high pressure by indirect heat exchange with the aforesaid flashed first process stream. In a preferred embodiment, the improvement comprising the following steps: (a) compressing from a first pressure to a second pressure a gaseous mixed refrigerant stream; (b) cooling and at least partially condensing the aforesaid mixed refrigerant stream to produce an at least partially liquid refrigerant stream; (c) flashing the at least partially liquid stream from step (b) to a reduced pressure which is at or above the aforesaid first pressure; (d) at least partially vaporizing the reduced pressure stream from step (c) by indirect heat exchange with a second process stream to thereby provide refrigeration to cool the second process stream: (e) heating the reduced pressure stream from step (d) by indirect heat exchange with the first process stream, to thereby provide refrigeration to cool and, optionally when the first process steam is a vapor or partially a vapor, at least partially liquefy the first process stream and provide a heated completely vaporized mixed refrigerant stream; (f) recycling the completely vaporized mixed refrigerant stream from step (e) to step (a); (g) flashing at least a first portion of the cooled first process stream from step (e) to a lower pressure; and; (h) at least partially vaporizing at least the aforesaid first portion of the cooled first process stream from step (g) by indirect heat exchange with the mixed refrigerant stream to thereby provide refrigeration to cool the mixed refrigerant stream in step (b).

In one preferred embodiment, the process of the present invention is employed in the recovery of light olefins from a mixed gas stream, and in a more preferred form of that embodiment, in the recovery of ethylene from a gaseous hydrocarbon stream.

BRIEF DESCRIPTION OF THE DRAWING

For a more complete understanding of invention, reference should now be made to the embodiment illustrated in greater detail in the accompanying drawing and described below by way of an example of the invention.

Figure 1:
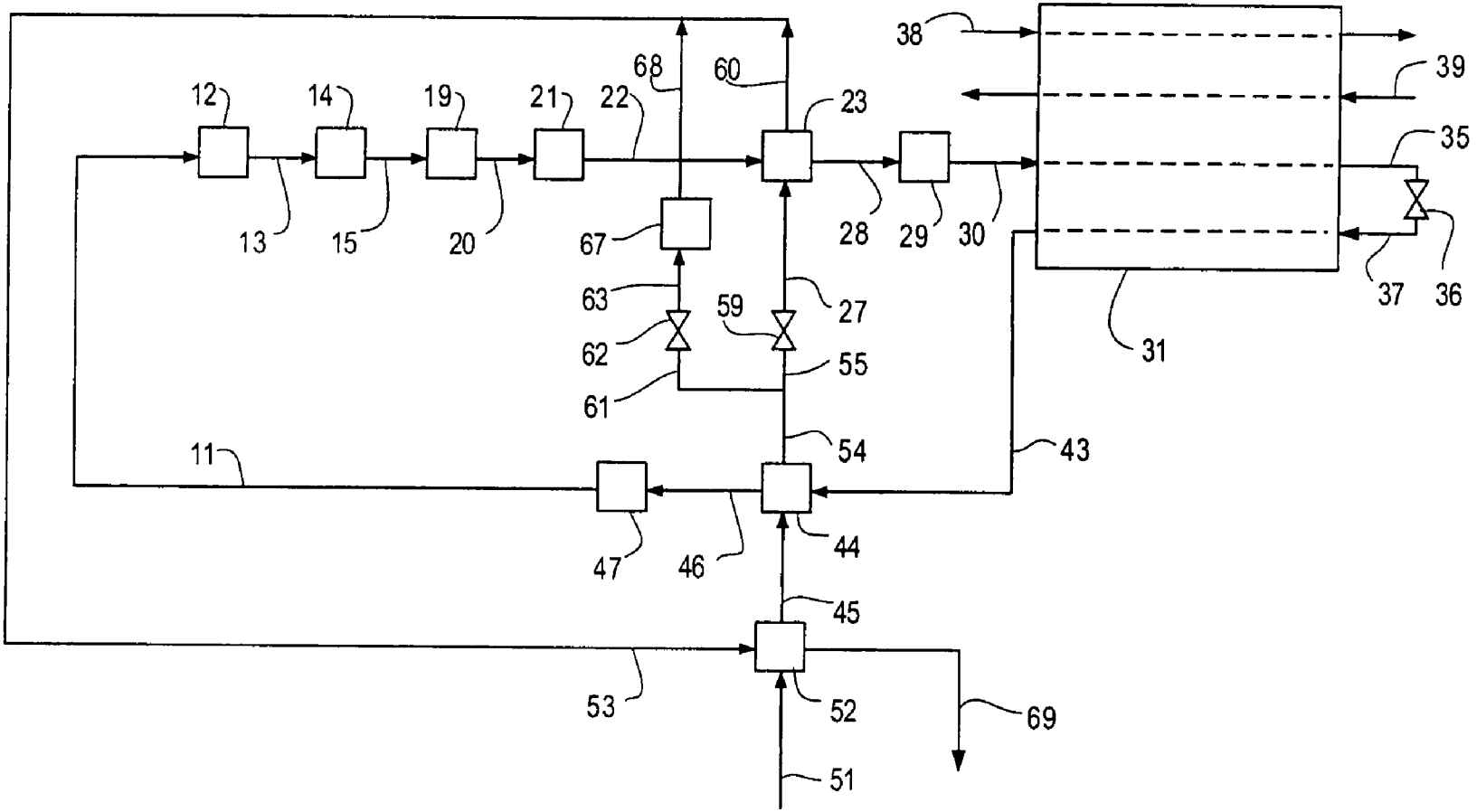
FIG. 1 is a schematic illustration of a preferred embodiment of the refrigeration system employed in the method of invention.

It should be remembered that the drawing is not to scale and is schematic in nature. In certain instances, details which are not necessary for an understanding of the present invention or which render other details difficult to perceive may be omitted. It should be understood, of course, that the invention is not necessarily limited to the particular embodiments illustrated herein.

DETAILED DESCRIPTION OF THE PREFERRED EMBODIMENTS

Although the mixed refrigerant system of the present invention can be used in a wide range of applications including, for example, the liquefaction of natural gas, the recovery of ethylene, ethane or heavier hydrocarbons from numerous feed gases containing ethylene, hydrogen and C1 to C3 hydrocarbons, for example, from a refinery or petrochemical offgas, or ethylene plant, it will be exemplified primarily in the recovery of ethylene from an ethylene plant. Typically, the feed gas comprises from 3 to 50 mole percent of methane, from 10 to 45 mole percent of ethylene, and from 5 to 50 mole percent of hydrogen. When the feed gas comprises cracked gas from a hydrocarbon cracker, preferably the cracked gas comprises from 15 to 50 mole percent of methane, from 10 to 30 mole percent of ethylene, and from 5 to 25 mole percent of hydrogen. When the feed gas comprises the offgas stream from a refinery, for example, from a fluidized catalytic cracking unit, typically the feed gas comprises from 3 to 35 mole percent of methane, from 20 to 45 mole percent of ethylene, and from 10 to 50 mole percent of hydrogen.

The recovery of ethylene from a feed gas containing ethylene, hydrogen, and $C_1$ to $C_3$ hydrocarbons can be accomplished in a number of ways. One such method includes the steps of compressing the feed gas, cooling the compressed feed gas to condense a portion thereof, in single stage condensers (or cold boxes against re-heat streams) or alternatively in one or more dephlegmators which impart several stages of separation during the condensation step. The condensate is separated from lighter gases and is passed to one or more demethanizer columns which recover a light overhead gas comprising chiefly methane and hydrogen, and a bottoms stream rich in $C_2$ and $C_3$ hydrocarbons. This hydrocarbon stream is typically further fractionated to yield a high purity ethylene product, an ethane-rich byproduct, and a stream of $C_3$ and heavier hydrocarbons. Typically at least a portion of the uncondensed hydrogen-methane vapor stream from the final ethylene recovery step is sent to a conventional hydrogen recovery section to produce a high-purity hydrogen product and one or more methane-rich streams.

In one preferred embodiment, the present invention involves an ethylene plant, wherein a pyrolysis gas is first processed in a known manner to recover and purify ethylene and possibly propylene and other by-products. The separation of the gas in an ethylene plant through condensation and fractionation at cryogenic temperatures requires refrigeration over a wide temperature range. The capital cost involved in the refrigeration system of a ethylene plant can be a significant part of the overall plant cost. Therefore, capital savings for the refrigeration system will significantly affect the overall plant cost.

The majority of all ethylene plants use an ethylene-propylene cascade refrigeration system to provide the major portion of refrigeration required in the ethylene plant. Most of the propylene (high level) refrigeration is utilized at several pressure/temperature levels in the initial feed precooling and fractionation sections of the plant to cool the feed from ambient temperature to about −35° F. and to condense the ethylene refrigerant at about −30° F. Similarly, the ethylene (low level) refrigeration is utilized at several pressure/temperature levels in the cryogenic section of the plant to cool the feed from −35° F. to about −145° F. in order to condense the bulk of the ethylene in the form of liquid feeds to a demethanizer column, and in the demethanizer column overhead condenser at about −150° F. to provide reflux to that column. Ethylene is normally not used to provide refrigeration below −150° F. since that would result in sub-atmospheric pressure at the suction of the ethylene compressor. Refrigeration below −150° F. to condense the remaining ethylene from the feed, is provided primarily by work expansion of the rejected light gases hydrogen and methane, and/or by vaporization of methane refrigerant which has been condensed by ethylene refrigerant. The work expanded gases are normally used as fuel and can consist of the overhead vapor from the demethanizer column, and any uncondensed feed gas, mostly hydrogen and methane, which is not processed in the hydrogen recovery section of the ethylene plant, and cold hydrogen-rich and methane-rich streams from the hydrogen recovery section.

With the conventional process technology described above, the feed gas chilling and demethanizing must be carried out at pressures in the range of 400 to 650 psia in order to achieve high ethylene recovery (99% or more) because the propylene/ethylene cascade system can provide refrigeration no colder than −150° F. for feed gas chilling and for demethanizer column condenser refrigeration. The amount of refrigeration for feed cooling below −150° F. which can be produced from other process streams in an ethylene plant is limited by operating constraints such as the amount of high pressure hydrogen recovered and the fuel system pressure(s). These constraints limit the amount of expander refrigeration which can be produced, which in turn limits the ethylene recovery. Pressures between 400 to 650 psia are required in the feed gas chilling train and in the demethanizer column so that most of the ethylene can be condensed above −150° F., and so that sufficient fuel gas expansion refrigeration at colder temperatures is available to condense most of the remaining ethylene and achieve low ethylene loss in the demethanizer column overhead vapor.

The tertiary refrigerant of the present invention comprises a mixture of methane, ethylene and/or ethane, and propylene and/or propane. The preferred percentages of these components in the tertiary refrigerant will vary depending on the ethylene plant cracking feedstock, the cracking severity and the chilling train pressure among other considerations, but will generally be in the range of 5 to 40 mole percent methane, 40 to 70 mole percent ethylene and/or ethane and 5 to 20 mole percent propylene and/or propane. A typical composition would be 30 mole percent methane, 60 mole percent ethylene and 10 mole percent propylene. The use of the tertiary refrigerant provides the refrigeration load and temperatures required for an ethylene plant having a relatively low-pressure demethanizer while obviating the need for three separate refrigerant systems. The tertiary refrigerant of this invention can also be used with a high-pressure demethanizer. In that case, the tertiary system can be designed to provide ethylene and propylene levels of refrigeration. The preferred methane content in the refrigerant would then be less than 15 mole percent.

The key aspects of the refrigeration system of this invention include heating of relatively low-pressure mixed refrigerant and at least partial condensation of relatively high pressure mixed refrigerant, where an external process stream is used in both the heating and condensation steps. The improved closed-loop mixed refrigeration system of the present invention reduces the capital cost for refrigeration and provides operational stability.

The present invention is an improvement in a refrigeration process that comprises: heating a mixed refrigerant stream at relatively low pressure by indirect heat exchange with a first process stream to thereby cool the first process stream; flashing the aforesaid cooled first process stream to a lower pressure; and cooling and at least partially condensing the aforesaid mixed refrigerant stream at relatively high pressure by indirect heat exchange with the aforesaid flashed first process stream. Optionally, if the first process stream is a vapor or partially a vapor, it is at least partially liquified in the first step.

More particularly, in the process of this invention, (a) a gaseous mixed refrigerant stream is compressed from a first pressure to a second pressure; (b) the aforesaid mixed refrigerant stream is cooled and at least partially condensed to produce an at least partially liquid refrigerant stream; (c) the at least partially liquid refrigerant stream from step (b) is flashed to a lower pressure which is at or above the aforesaid first pressure; (d) the reduced pressure stream from step (c) is at least partially vaporized by indirect heat exchange with at least a second process steam to thereby provide refrigeration to cool the aforesaid second process stream; (e) the reduced pressure stream from step (d) is heated by indirect heat exchange with the first process stream to thereby provide refrigeration to cool the first process stream and produce a heated gaseous reduced pressure mixed refrigerant stream; (f) the heated gaseous mixed refrigerant stream form step (e) is recycled to step (a); (g) at least a first portion of the cooled first process stream from step (e) is flashed to a lower pressure; and (h) the aforesaid first portion of the first process stream from step (g) is at least partially vaporized by indirect heat exchange with the mixed refrigerant stream, to thereby provide refrigeration to cool the mixed refrigerant stream in step (b). Optionally, if the first process stream is a vapor or partially a vapor, it is at least partially liquified in step (e).

In a more preferred embodiment, a second portion of the first process stream from step (e) is flashed to a lower pressure in step (i) and at least partially vaporized in step (j) by indirect heat exchange with a third process stream. In an even more preferred embodiment the at least partially vaporized first and second portions of the first process stream from steps (h) and (j) are combined and heated by indirect heat exchange with the first process stream before it is cooled in step (e).

Typically the mixed refrigerant comprises methane, ethane and/or ethylene, propane and/or propylene, or butane and/or butylene, or mixtures thereof. Preferably the mixed refrigerant comprises methane, ethane and/or ethylene, or propane and/or propylene. The first process stream can comprise one or more components. The cooled first process stream produced in step (e) is preferably a subcooled liquid.

In a preferred embodiment, the method of this invention is employed in a process for the recovery of light olefins from a mixed gas stream wherein the recovery comprises the steps of compressing and cooling the mixed gas stream to condense a portion thereof and fractionating the resulting condensed liquid to recover a product comprising the light olefins. The cooling of the mixed gas stream is provided by the refrigeration process of the present invention, in which the aforesaid second process stream employed in aforesaid step (d) is the mixed gas from which the light olefins are recovered.

In a more preferred embodiment, the method of this invention is employed in a process for the production and recovery of ethylene from a gaseous hydrocarbon feed stream wherein the hydrocarbon feed stream in converted to a mixed gas steam comprising ethylene and wherein the recovery comprises the steps of compressing and cooling the mixed gas stream to condense a portion thereof and fractionating the resulting condensed liquid to recover ethylene. The cooling of the mixed gas stream is provided by the refrigeration process of the present invention, in which the aforesaid second process stream employed in aforesaid step (d) is the mixed gas stream from which the ethylene is recovered.

FIG. 1 depicts a preferred embodiment of this invention within a generic mixed refrigerant system. In this system a relatively low pressure gaseous mixed refrigerant stream 11 is compressed in a first stage compressor 12. The resulting partially compressed stream 13 optionally can be cooled in exchanger 14, for example, against cooling water, to produce stream 15 which is then further compressed in a second stage compressor 19. It is possible that stream 15 is partially condensed as it exits 14. If this is the case, the vapor and liquid are separated, and only the vapor sent to compressor 19. The liquid can be pumped to higher pressure and rejoins the mixed refrigerant at a downstream location.

The final compressed mixed refrigerant stream 20 is cooled and possibly partially condensed in exchanger 21. It should be noted that in practice exchanger 21 could represent a plurality of exchangers. For example, the cooling step represented by exchanger 21 will typically involve cooling water, air, or some other ambient cooling medium. This could be followed by exchange with cold process streams and/or one or more levels of refrigeration from a separate refrigeration system, such as a propylene refrigeration system, if sub-ambient temperatures are desired. The cooled stream 22 exiting cooling exchanger 21 then enters exchanger 23 where it is further cooled and partially condensed against vaporizing stream 27. The resulting mixed refrigerant stream 28 can be further chilled and condensed against a separate refrigeration system or cold process streams in exchanger 29.

The final chilled compressed mixed refrigerant stream 30 enters exchanger 31. Stream 30 may be a liquid stream, or it may represent a partially condensed stream containing both liquid and vapor. The state of stream 30 does not limit the scope of this invention. If stream 30 is a mixed-phase stream, the vapor and liquid would typically be separated and separately treated in downstream exchanger 31. In FIG. 1, stream 30 is assumed to be a liquid stream. Exchanger 31 will typically be a multi-pass heat exchanger in which heat is exchanged between multiple streams. For clarity FIG. 1 depicts a very simple design for exchanger 31, utilizing a single full pass for each stream in the exchanger. In reality the design of exchanger 31 will typically be much more complex, utilizing multiple exchanger cores, multiple passes, and intermediate entry and exit points. The design of such exchangers is well known to those skilled in the art and all such design variations are included within the scope of this invention.

Stream 30 is further cooled as it traverses exchanger 31 to produce subcooled liquid stream 35. Stream 35 is then throttled to a lower pressure utilizing valve 36 or other suitable pressure reducing means. The pressure reduction reduces the temperature of stream 35 to produce stream 37. Stream 37 is then directed back through exchanger 31 where any liquid in the stream is vaporized to provide refrigeration within exchange 31. Typically steam 37 is completely vaporized within exchanger 31. The process stream to be chilled, stream 38 (identified in the claims below as the "second process stream"), also enters exchanger 31 and traverses the exchanger as shown. Refrigeration can also be recovered by rewarming cold process stream 39 (identified in the claims below as the "third process stream") in exchanger 31 as shown.

The vaporized stream 43 then enters exchanger 44 where it is warmed by contact with liquid stream 45. If desired, the warmed mixed refrigerant stream 46 can be further warmed against a suitable medium in exchanger 47 before it is recirculated back to the first stage of compression as stream 11.

The process of this invention utilizes another process stream 51 (identified in the claims below as the "first process stream"). Preferably stream 51 is a liquid and can be taken from within a larger process, for example, stream 51 can be an intermediate stream within the process, a final product of the process, or a feed stream to the process. For example, in an ethylene process it can be a stream taken from a point within the chilling or separation train, or it could be a feed to the furnaces such as ethane, propane, or a mixture of ethane and propane. Optimally, stream 51 will contain a mixture of components so that it vaporizes over a range of temperatures rather than at a single fixed temperature.

Stream 51 is chilled in exchanger 52 against stream 53. The chilled stream 45 is directed to exchanger 44 where it is further chilled against rewarming mixed refrigerant as described above to produce stream 54. Stream 54 is a subcooled liquid, that is, a liquid at a temperature below its bubble point. Stream 54 can be split into two or more branches if desired. The first branch, represented by stream 55, is throttled to a lower pressure by valve 59 to produce stream 27. Preferably, stream 27 is at its bubble point, or slightly subcooled. Stream 27 is directed to exchanger 23 where it is at least partially vaporized to provide duty to at least partially condense the compressed mixed refrigerant stream 22. The vaporized stream 60 exits exchanger 23 as shown.

The second branch of the subcooled liquid is represented by stream 61. It is throttled to a lower pressure by valve 62 to produce stream 63. Preferably, stream 63 is at its bubble point, or slightly subcooled. This stream can be directed to other refrigeration users in the process, depicted in FIG. 1 as exchanger 67. The vaporized stream 68 exits exchanger 67 and combines with stream 60 to form stream 53. Stream 53 can then be warmed in exchanger 52 to provide the initial chilling of stream 51 as described above and produce a final warmed stream 69.

Other modifications to the refrigeration system depicted in FIG. 1 can be envisioned by those skilled in the art and are encompassed within the scope and spirit of the invention depicted in FIG. 1.

The present invention will be more clearly understood from the following specific example.

EXAMPLE 1

This is an example of the process of the present invention for use in the practice of a process for the recovery of ethylene from a mixed hydrocarbon stream. The process of this example was simulated using a commercially available process simulation package. In this example, stream 38 is the overhead vapor of a deethanizer column and contains primarily hydrogen, methane, ethylene, and ethane. It is chilled in a single pass within exchanger 31. Other arrangements, including multiple passes with intermediate vapor/liquid separation steps, could also be used. In this example, stream 51 is a high-pressure liquid furnace feed consisting primarily of ethane and propane. In this example a mixed refrigerant containing 20 mole percent methane, 60 mole percent ethane, and 20 mole percent propane was selected.

The process simulated in the example is identical to the preferred embodiment of FIG. 1, except that exchangers 47, 52, and 67 are not used in this example. Also for simplicity, no reheat stream 39 is included in this example, though in a typical ethylene installation there would be one or more process streams reheated in exchanger 31. Selected stream information is given in Table 1, with stream numbers referenced to FIG. 1. Exchanger duties for the example (in millions of BTUs per hour) are given in Table 2, with exchanger identifications referenced to FIG. 1. Exchanger 21 in the figure was replaced with four exchangers in the example to more practically simulate the process. In the example the compressor 19 outlet stream was cooled and condensed first against cooling water, then against 50° F. propylene refrigerant, then against a cold process stream, and finally against 0° F. propylene refrigerant. Table 2 shows the sum of all of these duties as the exchanger 21 duty. Also, the duty shown for 31, the multipass exchanger, is the total heat removed from stream 38.

TABLE 1

| | Stream Flows and Compositions | | | | | | | | | | | | |
|---|---|---|---|---|---|---|---|---|---|---|---|---|---|
| Stream | 11 | 20 | 22 | 27 | 28 | 30 | 35 | 37 | 43 | 46 | 51 | 53 | 54 |
| Temperature (° F.) | 42.6 | 217.1 | 25.0 | −37.6 | −28.9 | −40.0 | −100.0 | −133.8 | −50.7 | 42.6 | 80.0 | −12.4 | −11.6 |
| Pressure (psig) | 30.0 | 351.0 | 345.0 | 95.0 | 343.0 | 341.0 | 341.0 | 30.0 | 30.0 | 30.0 | 880.0 | 93.0 | 878.0 |
| Vapor Fraction | 1.00 | 1.00 | 0.47 | 0.11 | 0.03 | 0.00 | 0.00 | 0.17 | 1.00 | 1.00 | 0.00 | 1.00 | 0.00 |
| Mole Flow (lb mol/hr) | | | | | | | | | | | | | |
| Methane | 3114.2 | 3114.2 | 3114.2 | 115.0 | 3114.2 | 3114.2 | 3114.2 | 3114.2 | 3114.2 | 3114.2 | 115.0 | 115.0 | 115.0 |
| Ethylene | 0.0 | 0.0 | 0.0 | 90.0 | 0.0 | 0.0 | 0.0 | 0.0 | 0.0 | 0.0 | 90.0 | 90.0 | 90.0 |
| Ethane | 9342.6 | 9342.6 | 9342.6 | 6314.0 | 9342.6 | 9342.6 | 9342.6 | 9342.6 | 9342.6 | 9342.6 | 6314.0 | 6314.0 | 6314.0 |
| Propylene | 0.0 | 0.0 | 0.0 | 1.2 | 0.0 | 0.0 | 0.0 | 0.0 | 0.0 | 0.0 | 1.2 | 1.2 | 1.2 |
| Propane | 3114.2 | 3114.2 | 3114.2 | 1151.0 | 3114.2 | 3114.2 | 3114.2 | 3114.2 | 3114.2 | 3114.2 | 1151.0 | 1151.0 | 1151.0 |
| iso-Butane | 0.0 | 0.0 | 0.0 | 0.0 | 0.0 | 0.0 | 0.0 | 0.0 | 0.0 | 0.0 | 0.0 | 0.0 | 0.0 |
| n-Butane | 0.0 | 0.0 | 0.0 | 4.8 | 0.0 | 0.0 | 0.0 | 0.0 | 0.0 | 0.0 | 4.8 | 4.8 | 4.8 |

TABLE 2

| Exchanger Duties | |
|---|---|
| Exchanger | Duty (mBTU/hr) |
| 14 | −14.0 |
| 21 | −83.1 |
| 23 | 41.4 |
| 29 | −4.7 |
| 31 | −80.8 |
| 44 | 17.2 |

While the invention is described in connection with a specific example, it is to be understood that this is for illustrative purposes only. Many alternatives, modifications and variations will be apparent to those skilled in the art in the light of the above example; and such alternatives, modifications and variations fall within the spirit and scope of the appended claims.

What is claimed is:

1. In a refrigeration process employing a mixed refrigerant system, the improvement comprising:

heating the mixed refrigerant stream at relatively low pressure by indirect heat exchange with a first process stream to thereby cool and, when the first process stream is a vapor or partially a vapor, at least partially liquefy the first process stream;

flashing the aforesaid cooled first process stream to a lower pressure; and cooling and at least partially condensing the aforesaid mixed refrigerant stream at relatively high pressure by indirect heat exchange with the aforesaid flashed first process stream.

2. The process of claim 1, wherein (a) a gaseous mixed refrigerant stream is compressed from a first pressure to a second pressure;

(b) the aforesaid mixed refrigerant stream is cooled and at least partially condensed to produce an at least partially liquid refrigerant stream;

(c) the at least partially liquid refrigerant stream from step (b) is flashed to a reduced pressure which is at or above the aforesaid first pressure;

(d) the reduced pressure steam from step (c) is at least partially vaporized by indirect heat exchange with a second process stream to thereby provide refrigeration to cool the aforesaid second process stream;

(e) the reduced pressure stream from step (d) is heated by indirect heat exchange with the first process stream to thereby provide refrigeration to cool and when the first process stream is a vapor or partially a vapor, at least partially liquefy the first process stream, and produce a heated gaseous reduced pressure mixed refrigerant stream;

(f) the heated gaseous mixed refrigerant stream from step (e) is recycled to step (a);

(g) at least a first portion of the first process stream from step (e) is flashed to a lower pressure; and (h) at least a first portion of the cooled first process stream from step (g) is at least partially vaporized by indirect heat exchange with the mixed refrigerant stream, to thereby provide refrigeration to cool the mixed refrigerant stream in step (b).

3. The process of claim 2 wherein a second portion of the cooled first process stream from step (e) is flashed to a lower pressure in step (i) and at least partially vaporized in step (j) by indirect heat exchange.

4. The process of claim 3 wherein the at least partially vaporized first and second portions of the first process stream from steps (h) and (j) are combined and heated by indirect heat exchange with the first process stream before it is cooled in step (e).

5. The process of claim 2 wherein the cooled first process stream in step (e) is a subcooled liquid.

6. The process of claim 1 wherein the mixed refrigerant stream comprises methane, ethane and/or ethylene, and propane and/or propylene.

7. The process of claim 1 wherein the first process stream comprises one or more components.

8. The process of claim 7 wherein the first process stream comprises two or more components.

9. In the recovery of light olefins from a mixed gas wherein the recovery comprises the steps of cooling the mixed gas to condense a portion thereof and fractionating the resulting condensed liquid to recover a product comprising the light olefins, wherein cooling the mixed gas is provide by a refrigeration process comprising:

heating a mixed refrigerant stream at relatively low pressure by indirect heat exchange with a first process stream to thereby cool and, when the first process stream is a vapor or partially a vapor, at least partially liquefy the first process stream;

flashing the aforesaid cooled first process stream to a lower pressure; and cooling and at least partially condensing the aforesaid mixed refrigerant stream at relatively high pressure by indirect heat exchange with the aforesaid flashed first process stream.

10. The process of claim 9, comprising:

(a) compressing from a first pressure to a second pressure a gaseous mixed refrigerant stream;

(b) cooling and at least partially condensing the aforesaid mixed refrigerant stream to produce an at least partially liquid refrigerant stream;

(c) flashing the at least partially liquid stream from step (b) to a reduced pressure which is at or above the aforesaid first pressure;

(d) at least partially vaporizing the reduced pressure stream from step (c) by indirect heat exchange with the aforesaid mixed gas to thereby provide refrigeration to cool the mixed gas;

(e) heating the reduced pressure stream from step (d) by indirect heat exchange with a first process stream, to thereby cool and, when the first process stream is a vapor or partially a vapor, at least partially liquefy the first process stream and produce a heated gaseous reduced pressure mixed refrigerant stream;

(f) recycling the heated gaseous mixed refrigerant stream from step (e) to step (a);

(g) flashing at least a first portion of the cooled first process stream, from step (e) to a lower pressure;

(h) at least partially vaporizing at least the aforesaid first portion of the cooled first process gas from step (g) by indirect heat exchange with the mixed refrigerant stream to thereby provide refrigeration to cool the mixed refrigerant stream in step (b).

11. The process of claim 10 wherein a second portion of the cooled first process stream from step (e) is flashed to a lower pressure in step (i) and at least partially vaporized in step (j) by indirect heat exchange.

12. The process of claim 11 wherein the at least partially vaporized first and second portions of the first process stream from steps (h) an (j) are combined and heated by indirect heat exchange with the first process stream before it is cooled in step (e).

13. The process of claim 10 wherein the cooled first process stream in step (e) is a subcooled liquid.

14. The process of claim 10 wherein the mixed refrigerant stream comprises methane, ethane and/or ethylene, propane and/or propylene, or butane and/or butylenes, or a mixture thereof.

15. The process of claim 10 wherein the mixed refrigerant stream comprises ethane and/or ethylene or propane and/or propylene, or mixtures thereof.

16. The process of claim 10 wherein the mixed refrigerant stream comprises methane, ethane, propane or a mixture thereof.

17. In the recovery of ethylene from a hydrocarbon feed stream wherein the hydrocarbon feed stream is converted to a mixed gas stream comprising ethylene and wherein the recovery comprises the step of cooling the mixed gas stream to condense a portion thereof and fractionating the resulting condensed liquid to recover ethylene, wherein cooling of the mixed gas stream is provided by a refrigeration process comprising the steps of:

heating a mixed refrigerant stream at relatively low pressure by indirect heat exchange with a first process stream to thereby cool and, when the first process stream is a vapor or partially a vapor, at least partially liquefy the first process stream, said first process stream comprising at least a portion of the aforesaid hydrocarbon feed stream:

flashing the aforesaid cooled first process stream; and cooling and at least partially condensing the aforesaid mixed refrigerant stream at relatively high pressure by indirect heat exchange with the aforesaid flashed first process stream.

18. The process of claim 17, comprising:

(a) compressing from a first pressure to a second pressure a gaseous mixed refrigerant stream;

(b) cooling and at least partially condensing the aforesaid mixed refrigerant stream to produce an at least partially liquid refrigerant stream;

(c) flashing the at least partially liquid refrigerant stream from step (b) to a reduced pressure which is at or above the aforesaid first pressure;

(d) at least partially vaporizing the reduced pressure refrigerant stream from step (c) by direct heat exchange with the aforesaid mixed gas stream to thereby provide refrigeration to cool the aforesaid mixed gas stream;

(e) heating the reduced pressure stream from step (d) by indirect heat exchange with the aforesaid first process stream to thereby provide refrigeration to cool and, when the first process stream is a vapor or partially a vapor at least partially liquefy the aforesaid first process stream and provide a heated gaseous lower pressure mixed refrigerant stream;

(f) recycling the completely vaporized mixed refrigerant stream from step (e) to step (a);

(g) flashing at least a first portion of the cooled first process stream from step (e) to a lower pressure; and (h) at least partially vaporizing at least the aforesaid first portion of the cooled first process stream from step (g) by indirect heat exchange with the mixed refrigerant stream, to thereby provide refrigeration to cool the mixed refrigerant stream in step (b).

19. The process of claim 18 wherein a second portion of the cooled first process stream from step (e) is flashed to a lower pressure in step (i) and is at least partially vaporized in step (j) by indirect heat exchange.

20. The process of claim 19 wherein the at least partially vaporized first and second portions of the first process stream from steps (h) and (j) are combined and heated by indirect heat exchange with the first process stream before it is cooled in step (e).

21. The process of claim 18 wherein the cooled first process stream in step (e) is a subcooled liquid.

22. The process of claim 17 wherein the mixed refrigerant stream comprises methane, ethane and/or ethylene, propane and/or propylene, or butane and/or butylenes, or a mixture thereof.

23. The process of claim 17 wherein the mixed refrigerant stream comprises ethane and/or ethylene or propane and/or propylene, or mixtures thereof.

24. The process of claim 17 wherein the first process stream comprises one or more components.

25. The process of claim 24 wherein the first process stream comprises at least ethane and propane.

* * * * *